US005497761A

United States Patent [19]

Mayr

[11] Patent Number: 5,497,761

[45] Date of Patent: Mar. 12, 1996

[54] HEATING DEVICE FOR SOLID FUELS

[76] Inventor: Konrad Mayr, 510 Miranda Dr., Pittsburgh, Pa. 15421

[21] Appl. No.: 210,024

[22] Filed: Mar. 18, 1994

[30] Foreign Application Priority Data

Mar. 22, 1993 [CH] Switzerland ..... 862/93

[51] Int. Cl.[6] ..... F24B 1/188

[52] U.S. Cl. ..... 126/523; 126/521; 126/500; 126/81; 126/83

[58] Field of Search ..... 126/523, 500, 126/502, 517, 522, 524, 529, 531, 81, 83, 80, 1 F, 22

[56] References Cited

U.S. PATENT DOCUMENTS

| | | | |
|---|---|---|---|
| 1,764,595 | 6/1930 | Anderson | 126/201 |
| 2,083,641 | 6/1937 | Crick | 126/42 |
| 5,329,915 | 7/1994 | Broadbent et al. | 126/524 |

*Primary Examiner*—Larry Jones

*Attorney, Agent, or Firm*—Collard & Roe

[57] ABSTRACT

The invention describes a heating device (1) for solid fuels (2) with a heating element (3) which comprises a combustion chamber (6) and adjacent thereto a flue gas conduit. Downstream of the combustion chamber (6) a suction device (30) for the flue gases (29) is arranged within the path of the flue gas conduit (39). A heat exchange unit (34, 78, 85) is arranged at least in the region of one of the two side walls (35, 36) and/or the rear wall of the heating element (3), whereby this unit is arranged at a distance from the side wall (35, 36) and/or the rear wall of the heating element (3) facing towards it. An admission opening (49) of the heat exchange unit (34, 78, 85) is connected to the interior (33) of the combustion chamber (6) by a discharge channel (32). The flue gases (29) are guided through the heat exchange unit (34, 78, 85) to an outlet opening (50), whereby the suction device (30) for the flue gases (29) is arranged within the path of the flue gas conduit (39) in the heat exchange unit (34, 78, 85) or in the region of the outlet opening (50) or whereby downstream thereof the suction device (30) for the flue gases ( 29 ) is arranged.

21 Claims, 6 Drawing Sheets

HEATING DEVICE FOR SOLID FUELS

BACKGROUND OF THE INVENTION

1. Field of the Invention

The present invention relates to a heating device for solid fuels.

2. The Prior Art

Heating devices, in particular for solid fuels such as wood, coal, pellets, wood chips or the like, or for gas and oil are known for many years, especially in the United States. Such stoves comprise a heating element which presents generally a combustion chamber that is laid out with fireclay bricks. A fuel storage bin for these solid fuels can be arranged at a distance thereabove. Apart from that, a gas or oil burner or a grate is arranged. To produce an appropriate suction effect, these stoves can be provided with a suction device extracting flue gases. This provides a large choice of flue gas guiding devices within the heating device. Moreover, in order to achieve sufficient thermal conduction at the smallest possible areas within the heating device between the room air to be heated and an adequate, uniform distribution of the heated air in the room, various heating devices are also provided with a ventilator to transport convection air or ambient air through the heating device. The feeding of the combustion chamber with solid fuels can be done manually or automatically, for example by means of a conveyer, which, in most cases, includes a spiral which removes solid fuels transported by gravity from the fuel storage bin and feeds the combustion chamber through a fall shaft.

The ignition and supply of solid fuels can take place automatically so that in connection with a room thermostat and an adequate control system, the rooms can also be heated by themselves through automatic control.

SUMMARY OF THE INVENTION

The object of the present invention is to improve the efficiency of such a heating device.

The object of this invention is achieved with a heating device for solid fuels with a heating element, which comprises a combustion chamber and adjacent thereto a flue gas conduit and in that downstream of the combustion chamber a suction device for flue gases is arranged within the path of the flue gas conduit, and whereby at least in the region of one of the two side walls and/or the rear wall of the heating dement a heat exchange unit is arranged at a distance from the side wall and/or the rear wall of the heating element facing towards it and that an admission opening of the heat exchange unit is connected to the interior of the combustion chamber by a discharge channel and that the flue gases are guided through the heat exchange unit to an outlet opening, whereby the suction device for the flue gases is arranged within the path of the flue gas conduit within the heat exchange unit or in the region of the outlet opening or downstream thereof. Through this, it is achieved in an advantageous and surprisingly simple manner that, due to the arrangement of a heat exchange unit through which the flue gases flow, a substantially improved efficiency with respect to known heating devices can be achieved, since a multiple of the thermal conduction area between the flue gases and the ambient air can be created as is the case with known heating devices. Additionally, equipping the heating device with such large heat exchange areas leads to the fact that the thermosiphon effect or the flowing along of the ambient air causes a decrease in unit weight since the ambient air is heated up and thereby, the air can be heated up without using an additional ventilator or a blower. Thus, the drive energy for such an additional ventilating device or the like, can be economized on, which improves the efficiency of the stove. Additionally, any draft formation through the heating device is prevented, particularly in living rooms and the generally increased dust circulation is avoided by the forced air circulation in living rooms, which achieves also in a surprising manner biological room air conditions in spite of the use of a heating device.

Furthermore, it is also advantageous if upstream of each side wall of the heating element a separate independent heat exchange unit is arranged, because this way, it is possible in the region of the two side walls of the heating device due to the size of the heat exchange unit to precisely regulate the energy to be used for radiation or thermal conduction.

A further development wherein an admission opening of each heat exchange unit is connected to an interior of the combustion chamber by its own discharge channel, ensures uniform heat distribution and radiation of the heating device into the two directions resulting in good utilization of the heat energy that has been achieved through the consumption of solid fuels.

A configuration wherein the heat exchange units are associated with a mutual aspiration opening, which forms a mutual outlet for the two flue gas conduits, is also advantageous, because it achieves equal suction conditions in the two heat exchange units and a uniform distribution of flue gases and thereby an optimal utilization of the heat energy therein.

On the other hand, a further development of an embodiment wherein the heat exchange unit encompasses in a U-shaped manner the side walls and a rear wall of the heating element, which, in the region of the combustion chamber is connected to the discharge channel associated with each side wall and comprises a single aspiration opening for the suction device of the flue gases, allows for the use of all peripheral surfaces of the heating element with the exception of the face for heat energy emission facing towards the operator.

A well-directed regulation of the flow velocity of the flue gases and a heat energy withdrawal in a purposeful manner is achieved according to the embodiment wherein baffle plates form a winding path of the flue gas conduit inside the heat exchange unit.

Full safety from bums can be achieved by a development wherein up-stream of the heat exchange unit and spaced therefrom a metal sheeting is arranged which is preferably attached to the heat exchange unit by means of a holding device.

A further development of an embodiment wherein ambient air passes through the convection channels, makes it possible that a maximum surface for thermal conduction between the flue gases and the ambient air can be achieved.

An embodiment wherein the discharge channels lead into the combustion chamber above the combustion chamber, preferably into the upper third thereof, is also advantageous, since the suspended matter which is still in the flue gases before their entry into the discharge channels can settle down.

If however, a configuration is used wherein the discharge channels lead into the combustion chamber below the leading edge of the grate or the bum pot facing towards the cover of the heating device, the suspended matter which might be in the flames will already have settled down in the upper end region of the combustion chamber.

Best utilization and uniform heat emission by means of the heat exchange unit can be achieved according to the embodiment wherein different zones of the heat exchange unit or different heat exchange units are connected to the combustion chamber by discharge channels which are independent from one another, and wherein each heat exchange unit or a group of heat exchange units is each associated with its own suction device for flue gases, because as a function of the temperature of the flue gas in the withdrawal area, the flow velocities of the flue gases in the individual heat exchange units can be regulated independent from one another by means of the individual suction devices, so that a maximum of energy output can be achieved.

If an embodiment is selected wherein between the metal sheeting and the heat exchange unit a further convection channel is formed, which, preferably is connected to the ambient air by cross-flow openings in the cover, then the amount of air of the ambient air, which flows along the outside of the heat exchange unit, can simply be predetermined.

A larger surface for thermal conduction can be achieved by a configuration wherein the heat exchange unit is provided with convection elements, in particular fibs or webs or the like, or which have a sheet metal surface in the form of a trapezoid.

By selecting the negative pressure developing in the suction device, the flow velocity of the flue gases can also be advantageously regulated if the suction device allows for the development of a predeterminable negative pressure of about 0.98 to 0.8 bars in the region of the discharge channels.

BRIEF DESCRIPTION OF THE DRAWINGS

The invention is explained hereinafter in further detail by means of the exemplary embodiments illustrated in the drawings, in which.

DETAILED DESCRIPTION OF PREFERRED EMBODIMENTS

Figure 1:
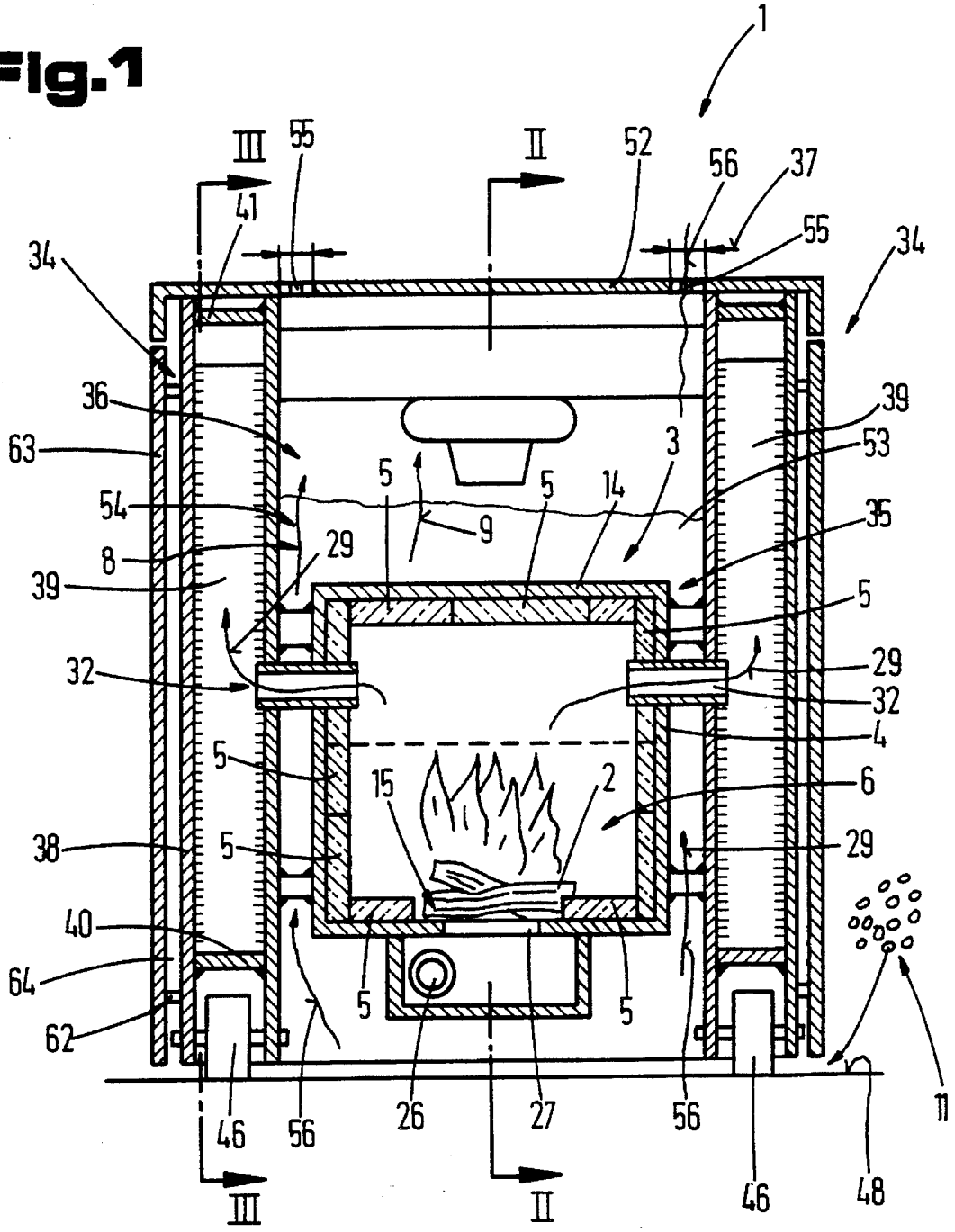
FIG. 1 is front view, in a section taken along the lines II—II in FIG. 2, of a heating device in accordance with the invention.
Figure 2:
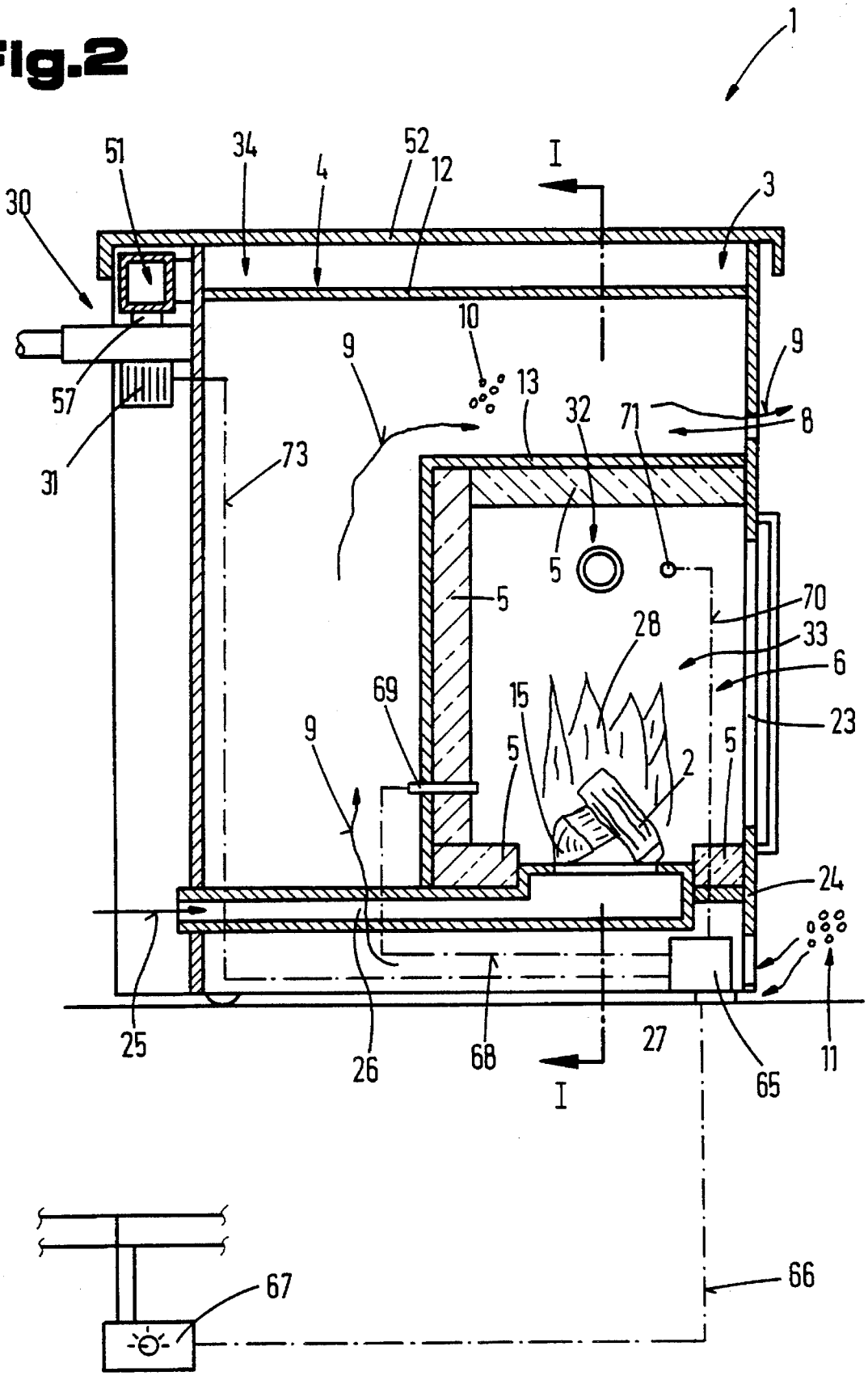
FIG. 2 is a side view, in a section taken along the lines III—III in FIG. 1, of the heating device in accordance with the invention.
Figure 3:
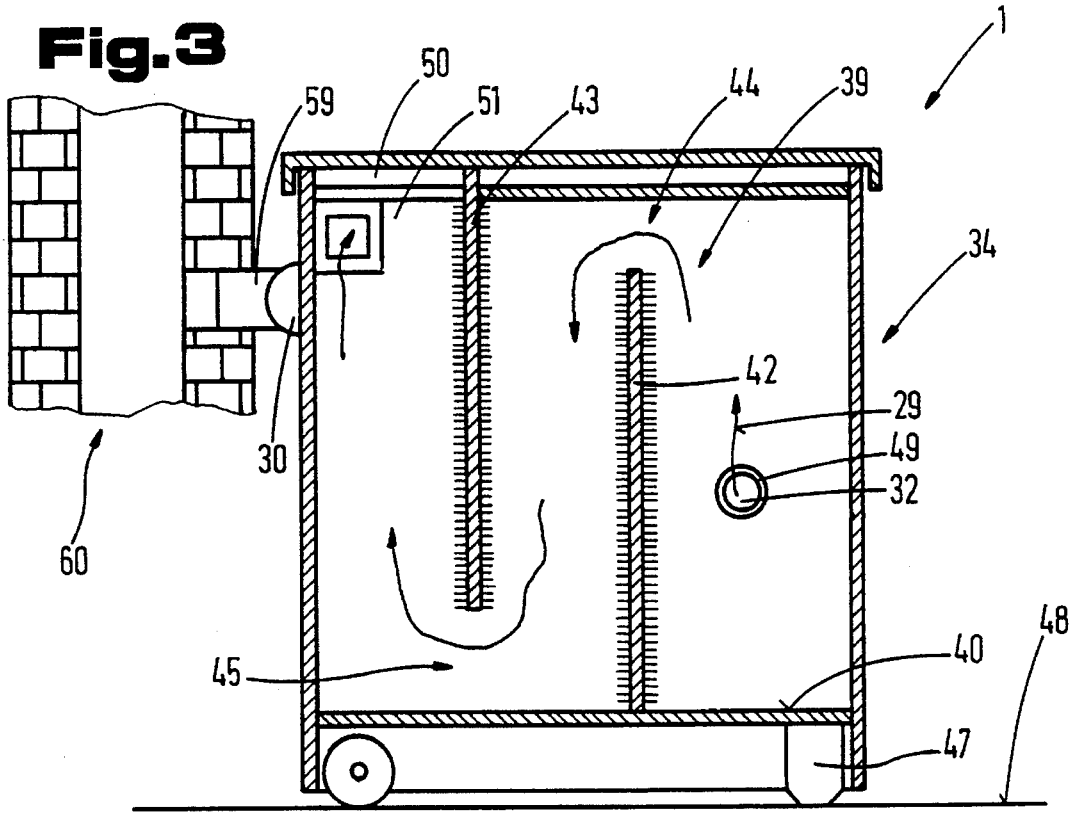
FIG. 3 is a side view, in a section taken along the lines III—III in FIG. 1, of the heating device in accordance with the invention according to FIGS. 1 and 2.
Figure 4:
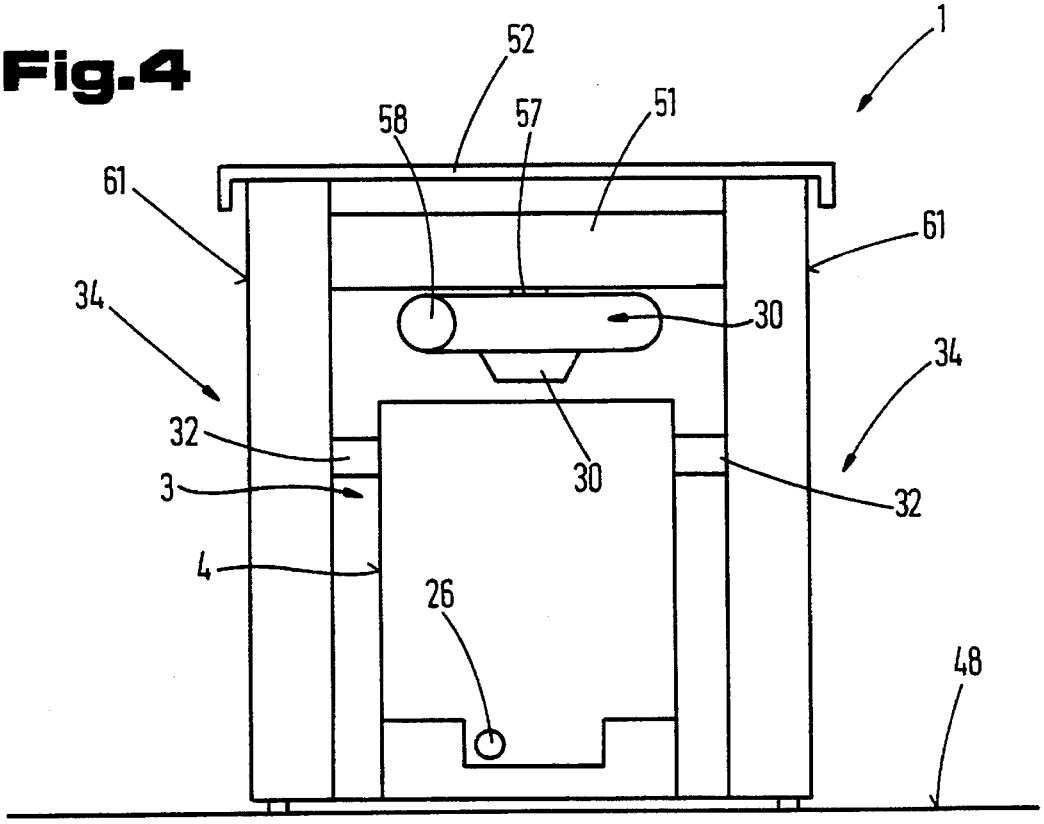
FIG. 4 is a rear view of the heating device in accordance with the invention according to FIGS. 1 to 3.

FIGS. 1 to 4 show a heating device 1 for burning solid fuels 2, such as wood, coal, coke or gas or oil, or small cylindrical chips made of compressed wood fibers, chopped up wood pieces or wood chips. This heating device comprises a heating element 3, in the housing 4 of which a fireclay-brick 5 laid out combustion chamber 6 is arranged. Above the combustion chamber 6 a cross channel 8 is arranged, through which— as indicated schematically by arrows 9—recirculated air or convection air 10 is flowing—schematically indicated by small rings—which is drawn out of an ambient air 11, guided through the cross channel 8 and which can be reintroduced into the ambient air 11 when heated up. This cross channel 8 is bordered at its upper side by a cover 12 and at its floor by a cover plate 13 of the combustion chamber 6. The cover 12 is provided with a heat reflecting layer, for instance, on its surface 14 facing towards the cross channel 8, or a heat reflecting surface, and moreover, is preferably made of a galvanized steel plate. Any other heat reflecting coating may however also be applied to the cover 12.

The combustion chamber 6 comprises a grate 15 and is accessible through a combustion chamber door 23, which is arranged in a from wall 24 of the housing 4 of the heating element 3.

For the supply of primary air—arrow 25—into the combustion chamber 6 a fresh air conduit 26, which terminates under the grate 15, is used. The supplied primary air enters the combustion chamber 6 through openings 27 and leads to a consumption forming flames 28 after ignition of the fuel 2. Flue gases 29 forming due to the consumption of fuels 2, schematically indicated by waved arrows, are sucked into he heat exchange unit 34 by a suction device 30, which is operated by an electric motor 31, and formed for example as a radial blower, via discharge channels 32, for example fused in pieces of tubes from the upper region of the interior 33 of the combustion chamber 6.

One heat exchange unit 34 is arranged at a distance 37 upstream of each side wall 35, 36 of the housing 4 of the heating element 3. Each of these heat exchange units 34 consists of a support housing 38 enclosing a hollow space which forms a flue gas conduit 39.

This flue gas conduit 39 runs in meanders because of baffle plates 42, 43 being arranged in the hollow space, extending alternately from a floor 40 and a covering plate 41 into the opposite direction, starting from the floor 40 or the covering plate 41 ending each time at the opposite covering plate 41 or the opposite floor 40 and which form thereby passages 44, 45. This forms the meander-shaped flue gas conduit 39, as can be seen best in FIG. 3.

Furthermore, in the support housing 38 rolls 46 are arranged, and also support legs 47, which support the heating device 1 on a floor surface 48.

The flue gases 29 coming from the discharge channel 32 flow through the flue gas conduit 39 passing an admission opening 49 and after having passed the meander-shaped flue gas conduit 39 flow through an outlet opening 50 into an outflow channel 51 which connects the two heat exchange units 34 behind the housing 4 of the heating element 3.

The two heat exchange units 34 and the heating element 3 are covered towards the top by a cover 52, in that in the extension forming the convection channels 53, 54 between the heating element 3 and the heat exchange units 34, cross-flow openings 55 are arranged for the passage of the amount of air of the floor surface 48 taken from the ambient air 11 in the direction of the cover 52, in the region of which it is discharged to the ambient air 11 after being heated up. This air flow in the convection channels 53 and 54 is schematically indicated by waved arrows 56. When passing through the outflow channel 51, the flue gases 29 can continue to give up heat to the ambient air and are entering thereafter the suction device 30 through an aspiration opening 57 before they enter the chimney 60 through a flue gas outlet 58 and a connecting sleeve 59.

During the passage of the flue gases 29 through the meander-shaped flue gas conduit 39, the high temperature of the flue gases 29 decreases more or less so that they enter the chimney 60 having the desired temperature.

It is particularly advantageous that a large surface of the heat exchange unit 34 is formed for the transfer of the heat energy that results from the burning of the fuels 2, to the ambient air 11, whereby all surfaces of the heat exchange unit 34 and also of the outflow channel 51 are surrounded by the ambient air 11, so that an intimate and rapid heat transfer can take place. By rerouting the flue gases 29 by means of baffle plates 42, 43 the temperature of the flue gases is also gradually reduced, so that it is possible with proper guidance of the flue gases 29 to maintain a temperature at a contact surface 61 of the heat exchange unit 34 at legally permissible limits.

In this connection, it is of course also possible in a further development in accordance with the invention, if desired, also on its own, to divide the heat exchange unit by a central wall extending right through into two heat exchange units panning parallel to one another or two heat exchange units arranged one above the other. The flue gases 29 flow first through the heat exchange area being closer to the combustion chamber 6 in order to cool down to such an extent, so that when flowing further into the outer heat exchange area or the heat exchange unit which is further away, the contact areas 61 of which are facing towards the user, they cannot heat up to more than the temperature allowed for safety reasons.

However, it is of course also possible that metal sheetings 63 or sheeting elements are suspended in front of the heat exchange units 34 by holding devices 62. By choosing an appropriate distance, convection channels 64 can be formed between these metal sheetings 63 and the heat exchange units 34. The heated air in these convection channels 64 can be transferred to the ambient air, for example passing between the metal sheetings 63 and the cover 52 or also through cross-flow openings 55 arranged in this region.

These metal sheetings 63 can of course also consist of other elements formed from different materials such as tiles or heat resisting plastic plates, for example of fiber glass reinforced plastic or the like.

In order to control the thermal output emitted by the heating device 1, a control device 65 is arranged, for example in the housing 4 of the heating element 3. This control device 65 is connected by lines 66 to a room thermostat 67 via a line 68 with a flame controller 69, via a line 70 with a temperature sensor 71 and via a line 73 with an electric motor 31 of the suction device 30.

As a function of the set temperature of the room thermostat 67, as described hereinafter in FIGS. 7 and 8, by adequately controlling the amount of fuel 2 which is brought by the conveyer, the amount of the fuel 2 to be burned and thereby the produced thermal output can be regulated. To ensure a safe and uniform consumption and a commensurate flame pattern of the flames 28 in the combustion chamber 6, the supplied amount of fuel is controlled by a flame controller 69 and in case of the flames decreasing, new fuel 2 is supplied or a warning signal put out.

A temperature sensor 71 is provided to prevent an overheating of the combustion chamber.

By means of the control system of the electric motor 31, the suction efficiency of the suction device 30 can be regulated so that the cross-flow velocity of the flue gases 29 through the flue gas conduit 39 as well as the amount of heat, which is transferred to the ambient air 11 by the heat exchange unit 34, can be precisely regulated or an overheating of the combustion chamber 6 prevented by proper control of the flow velocity of the flue gases 29.

The surprising advantage of this solution in accordance with the invention lies therefore in that the arrangement of the heat exchange unit 34 at a distance 37 from the front of the heating element 3, creates besides an enlargement of the surface also a thermal conduction between the flue gases 29 and the ambient air 11 due to the thermosiphon effect, and in comparison with the stoves presently available on the market having a suction device 30, neither a separate conveying device nor a blower for the ambient air 11 or the room air to be heated is required.

Figure 5:
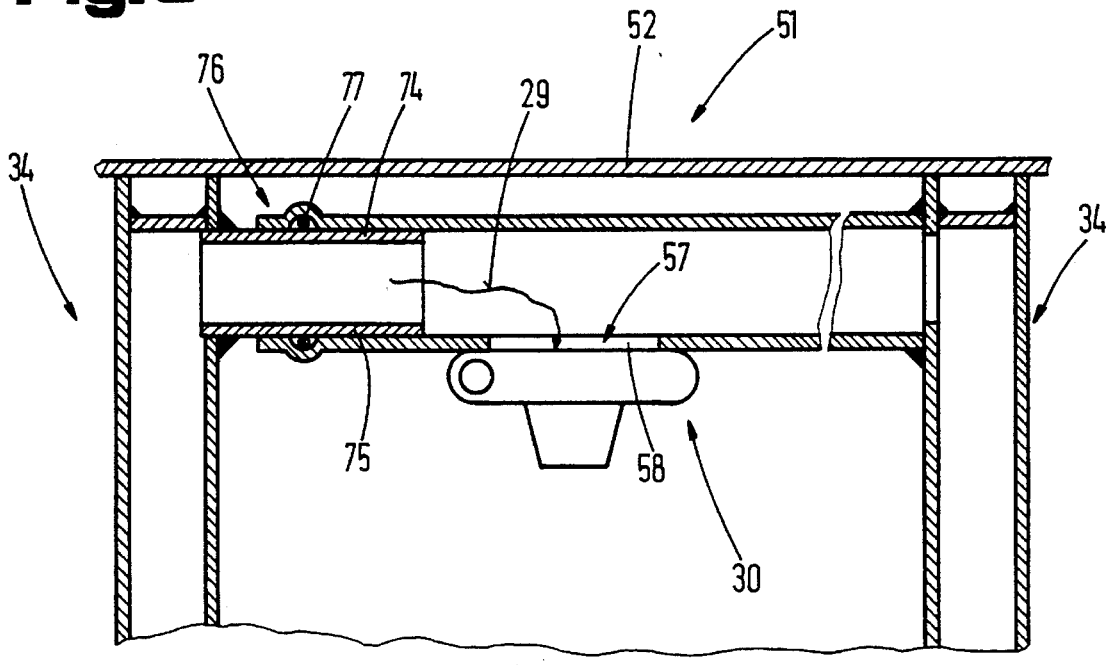
FIG. 5 is a front view, partially cut and a simplified diagrammatic representation of a discharge channel of the heating device in accordance with the invention.

FIG. 5 shows an embodiment of the outflow channel 51 which connects the two heat exchange units 34 to one another in the direction of the chimney 60.

To adapt rapidly, for example the distance between the heat exchange units 34 to differently sized heating elements 3 with different thermal outputs for instance, the outflow channel 51 consists of a channel piece 74 and a channel piece 75, whereby the channel piece 75 is connected immovably to one of the heat exchange units 34 and the channel piece 74 to the heat exchange unit 34 opposite thereof.

The diameters or the cross-sectional measure of the channel pieces 74, 75 are selected in such a manner that they can be displaced into one another in a telescopic way, whereby for example in the end section of the channel piece 74 a sealing device 76 can be arranged between this piece and the channel piece 75. This sealing device 76 may comprise a high temperature resisting ceramic sealing or a sealing cord 77.

Thereby, the suction device 30 is arranged in such a manner that with the smallest distance possible between the heat exchange units 34, an unimpeded afflux of the flue gases 29 to the suction device 30 can take place.

If a larger heating element 3 is installed between the heat exchange units 34, they are only to be displaced against one another whereby the extent of the enlargement of the distance between the heat exchange units 34 is determined by the overlapping length of the channel pieces 74, 75.

To ensure a seamless displacement, the discharge channels 32 or the pipes forming the latter, can be provided with appropriate extensions, which, if the measure is less between the two heat exchange units 34, project farther into the combustion chamber 6 or are produced with the required length to be shortened accordingly during assembly.

Figure 6:
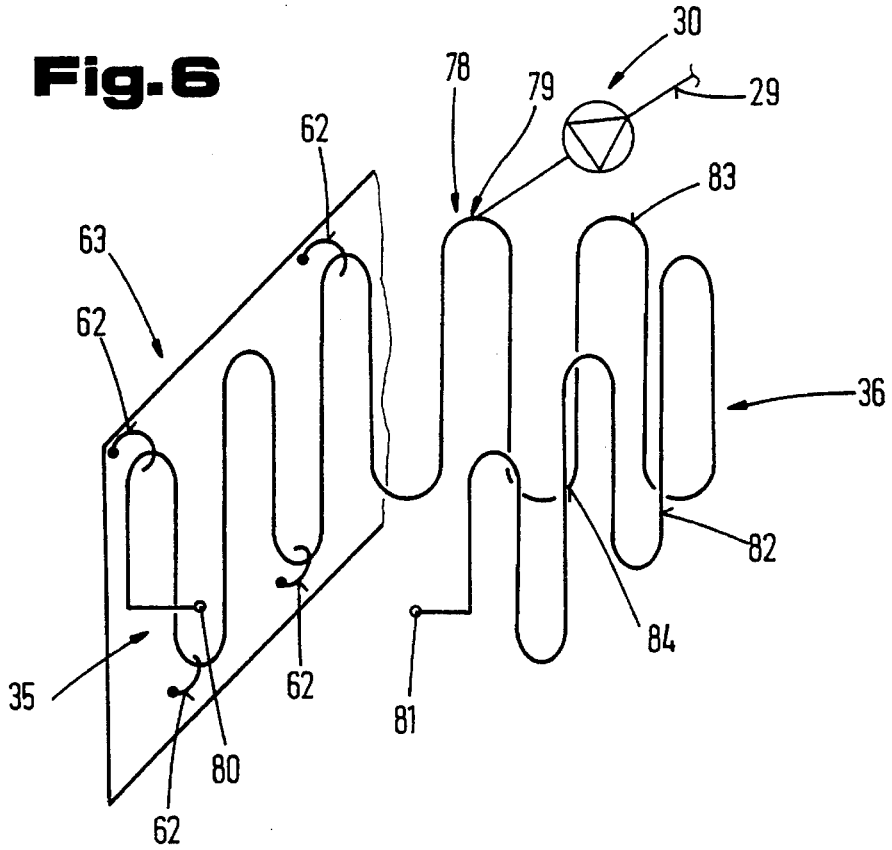
FIG. 6 is a greatly simplified, diagrammatic representation of another embodiment of a heat exchange unit associated with the heating device in accordance with the invention.

FIG. 6 shows another possible embodiment of a heat exchange unit 78. This heat exchange unit 78 is formed by a pipe meander 79. The diameter of these pipes can be adapted to the desired thermal output or the required passage cross-section for the flue gases.

In the present example of an embodiment, the heat exchange unit 78 is U-shaped, whereby the two pipe extremities 80, 81 lead into the combustion chamber 6 which is not shown for reasons of clarity. The flue gases 29 flow through the pipe meander whose straight pipe pieces 82 are running parallel to the height, i.e. perpendicular thereto. For example, in the base of the U-shaped pipe meander 79, at the highest position of a baffle arc 83 of a meander, the suction device 30 for the flue gases 29 is arranged. It is, of course, also possible to arrange this suction device 30 at any other location on the straight pipe pieces 82 or also in the region of the lower baffle arc 84. Of course, the illustrated pipe meander 79 may only extend across one side wall 35 or 36 of the heating element 3, for example.

Furthermore, these pipe meanders 79 may also be arranged in such a way for example, that the straight pipe pieces 82 are running horizontal and also parallel to the floor surface 48. To protect the user from contact and unintentional bums by touching the hot parts of the pipe meander 79, these metal sheetings 63 can be suspended at appropriate distances by adequate holding devices 62, for example directly on the pipe meander 79 or applied thereto.

These metal sheetings 63 can be made of different materials as already described hereabove in FIG. 1.

The material for the pipes of the pipe meander 79 can of course also be freely selected, and copper pipes for instance, or the like, may also be provided to achieve an improved thermal conduction.

The pipe meander 79 can also be associated with convection elements, flags, ribs or surfaces or be connected therewith, to achieve an even better thermal conduction between the flue gases 29 and the ambient air 11.

Figure 7:
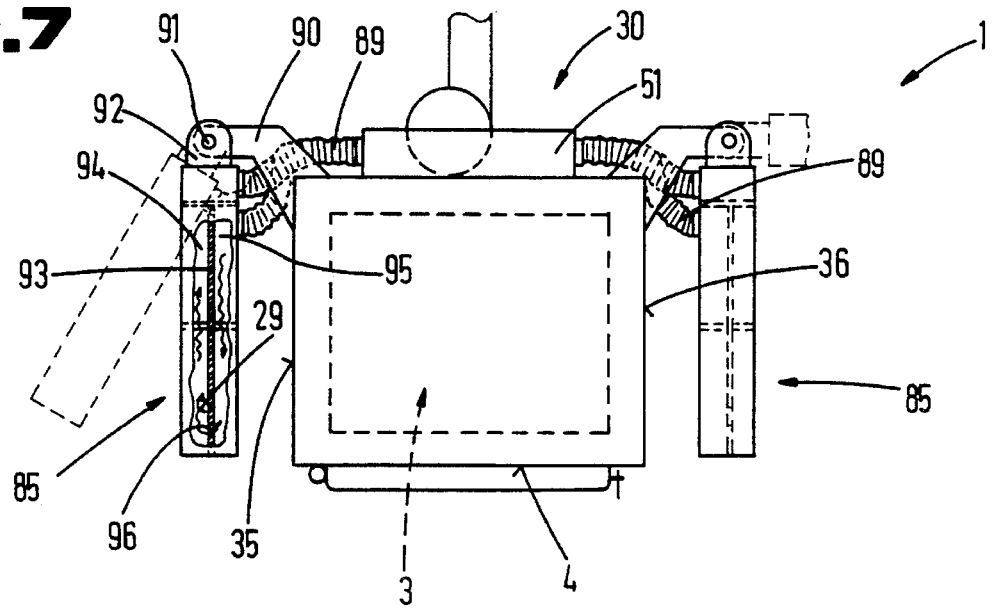
FIG. 7 is a top view, and a greatly simplified diagrammatic representation of a heating device with a relative adjustable heat exchange unit.
Figure 8:
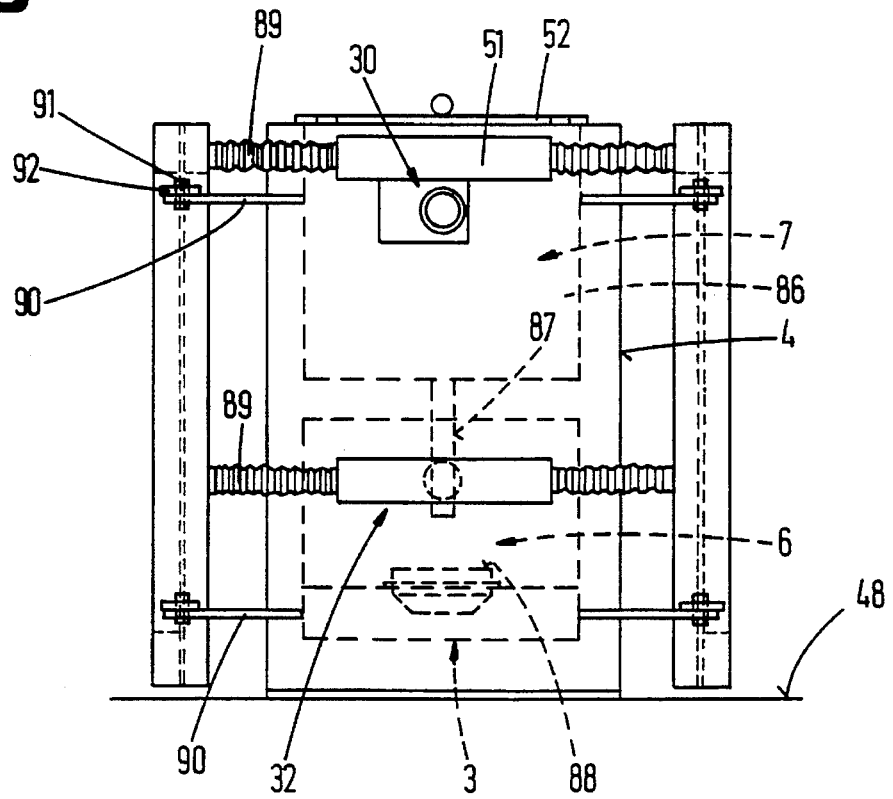
FIG. 8 is a rear view, partially cut, and a greatly simplified diagrammatic representation of the heating device according to FIG. 7.

FIGS. 7 and 8 show another embodiment of a heating device 1 wherein heat exchange units 85 are arranged on both sides.

This form of an embodiment of the heating device 1 is provided with a heating element 3 which is suitable for burning small-grain fuels such as wood or wood fiber materials such as pellets.

In a housing 4 this heating element comprises a combustion chamber 6 and has a storage bin 86 arranged thereabove. The granular solid fuels can thereby be transferred by a conveying device known from prior art or a fall shaft 87 to a bum pot 88 located in the combustion chamber 6.

However, the storage bin 86 can also be eliminated, and instead of the burn pot 88 a gas burner for example with the required reduction valves and control valves, or an oil burner may be used. The flue gases are discharged for example in the upper region of the combustion chamber 6, that is to say in the region of the cover 52 through a discharge channel 32, which is formed in such a way that one portion of the flue gases 29 are led to one heat exchange unit 85 and the remaining portion of the flue gases 29 to the other, for example by means of a flexible line 89.

Each heat exchange unit 85 is located on support arms 90, which are secured to the housing 4, in order to turn them around swivel pins 91 by means of swivel arms 92 from a position parallel to the side walls 35, 36 of the housing 4—as shown in full lines in FIGS. 7 and 8—into any desired swivel position—as indicated by broken lines.—In addition, this flexible horizontal swing can take place because the flue gases 29, as schematically indicated by arrows, which are guided through the heat exchange units 85 via a flexible, and also as the line 89, a high temperature resisting line 89, to the outflow channel 51 connected thereto, downstream of which the suction device 30 is arranged to extract the flue gases 29.

As furthermore shown in FIG. 7 in one of the heat exchange units 85, the latter can be subdivided in its longitudinal direction by a separating wall 93 into two different chambers 94, 95 which are interconnected to one another by a passage 96, as schematically indicated.

Therefore, the flue gases 29 flow from the combustion chamber 6 through the line 89 first into the chamber 95, i.e. through the chamber 95 which is closer to the heating element 3, whereby they are cooled to a certain extent while this flue gas 29 is again flowing through, for example, the flue gas conduit which, due to the baffle plates has the form of meanders, before it flows into the chamber 94 in which a further cooling and heat loss to the ambient air occurs.

Thus, the contact temperature on the outside of the heat exchange unit 85 can be reduced by the cooling of the flue gas 29 that took already place and a higher contact safety can be achieved. Then the discharge of the flue gases 29 can take place through the line 89 into the outflow channel 51 to the suction device 30.

Figure 9:
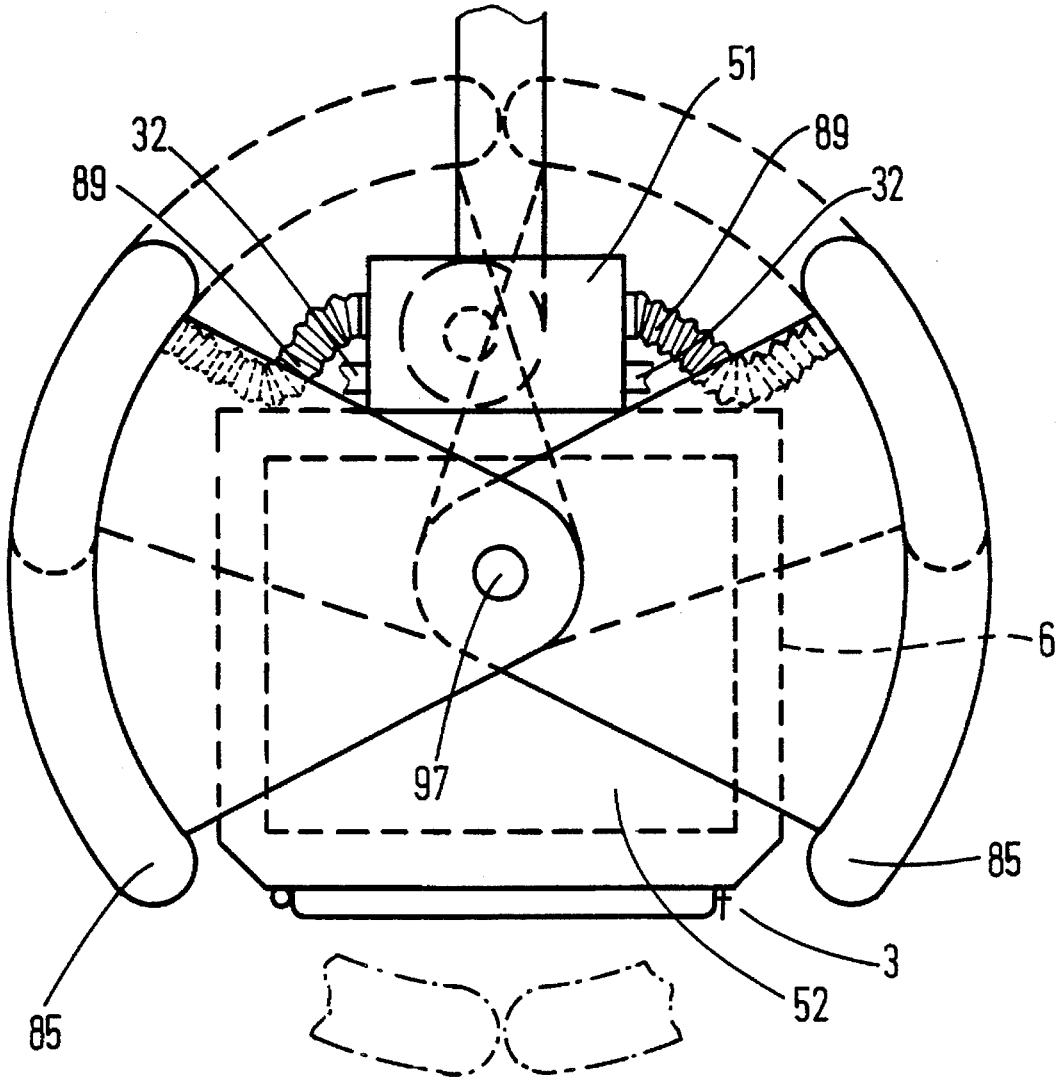
FIG. 9 is a top view and diagrammatic representation of another embodiment of the heating device with relative horizontally swingable heat exchange units.

FIG. 9 shows another embodiment of the heating device 1, which is also provided with adjustable heat exchange units 85. In this case, these heat exchange units 85 have the form of a semi-circle and are arranged around a central median axle 97, which can be secured to the heating element 3 or its cover 52. This makes it possible that these heat exchange units are pivoted from a position nearly encompassing the front of the heating device, into a position behind the heating device. If the heating element is designed accordingly, it is, of course, also possible—as indicated by broken lines—to pivot the latter into a position wherein only the heat exchange unit 85 is facing the viewer. These heat exchange units 85, as described in the exemplary embodiments hereabove, can also be provided with sheeting elements or sheet metals, which are placed in from of them and form an additional convection channel, to achieve, in any case that burns are prevented and thereby full safety of contact is provided when touched unintentionally.

The connection of the heat exchange unit 85 to the combustion chamber 6 arranged inside the heating element 3 takes place by discharge channels 32, which are only partially illustrated, whereas the draw-in of the flue gases 29 from the heat exchange units 85 into the outflow channel 51 occurs again through flexible, temperature resisting lines 89 that connect also the discharge channels 32 to the heat exchange units 85.

It is, of course, also possible within the scope of the invention that the heat exchange takes place instead of according to the exemplary embodiment shown in FIGS. 7 to 9 by swinging around a swivel pin, through a longitudinal or parallel displacement, for example by using parallelogram lever arrangements or the like.

In particular, the design of the heat exchange units 85 can be carded out in such a manner that these units limit the heating device 1 in the direction of the viewer. If, for example, the heat exchange units 85 are provided with tiles, this may give the impression of a tile stove, since the heat exchange units 85 arranged behind them cause the tiles to be heated up accordingly. To refill fuels, the heat exchange units 85 can be swiveled aside or displaced sidewardly to enable access to the combustion chamber door. Simultaneously, it is also possible to provide a view of the flames in the combustion chamber 6 by swiveling the heat exchange units 85.

Particular details described in the exemplary embodiments hereabove, especially the adjustable positioning of the heat exchange units 85 in FIGS. 7 to 9, and also other particular details in the above described exemplary embodiments, may also form their own solutions in accordance with the invention.

For good order's sake it should be pointed out that for improved understanding of the features in accordance with the invention, component parts or subassemblies have been illustrated out of proportion and are deformed, simplified and illustrated schematically or in a transparent manner.

In particular, the individual embodiments shown in FIGS. 1, 2, 3, 4; 5; 6; 7, 8; 9 may form their own solutions in accordance with the invention. The objects and solutions thereof can be found in the detailed description of these figures.

What is claimed is:

1. A heating device for solid fuels comprising (a) a heat element having side walls and a rear wall, (b) a combustion chamber inside the heating element, (c) a heat exchange unit arranged in the region of at least one of the side walls at a distance therefrom, the heat exchange unit comprising (1) a flue gas conduit for guiding flue gases along a path, the flue gas conduit defining an outlet opening at an end of the conduit, and (2) an inlet opening connected to the interior of the combustion chamber by a discharge channel and to the flue gas conduit, and (d) a suction device for the flue gases, the suction device being arranged within the path of the flue gases.

2. The heating device of claim 1, wherein the suction device is arranged in the region of the outlet opening.

3. The heating device of claim 1, wherein the suction device is arranged downstream of the outlet opening.

4. The heating device of claim 1, comprising a further heat exchange unit arranged in the region of the rear wall of the heating element at a distance therefrom.

5. The heating device of claim 1, comprising a separate independent one of the heating units arranged upstream of each side wall.

6. The heating device of claim 5, wherein the heat exchange units are associated with a common aspiration opening defining a common outlet for the flue gas conduits.

7. The heating device of claim 1, wherein the heat exchange unit is U-shaped and encompasses the side walls and rear wall of the heating element, a respective one of the discharge channels is associated with each side wall in the region of the combustion chamber, and the suction device has a single aspiration opening for the flue gases.

8. The heating device of claim 1, wherein baffle plates inside the heat exchange unit form a winding path of the flue gas conduit.

9. The heating device of claim 1, comprising a protective metal sheeting arranged upstream of the heat exchange unit and spaced therefrom.

10. The heating device of claim 9, further comprising a holding device attaching the protective metal sheeting to the heat exchange unit.

11. The heating device of claim 9, wherein the protective metal sheeting and the heat exchange unit define a convention channel therebetween, and a cover defines openings enabling ambient air to flow into the convection channel.

12. The heating device of claim 1, wherein the heating element and the heat exchange unit defines convection channels therebetween, and ambient air passes through the convection channels.

13. The heating device of claim 1, wherein the discharge channels lead into an upper part of the combustion chamber.

14. The heating device of claim 1, wherein different ones of the heat exchange units are connected with the combustion chamber by independent ones of the discharge channels, and a separate suction device is associated with each one of the heat exchange unit.

15. The heating device of claim 1, wherein the heat exchange unit comprises convection elements.

16. The heating device of claim 1, wherein the suction device is arranged to provide a pre-adjustable vacuum of about 0.98 to 0.8 bars in the region of the discharge channels.

17. The heating device of claim 1, wherein the heat exchange unit is formed as a pipe meander the ends of which extend into the interior of the combustion chamber.

18. The heating device of claim 1, wherein at least one heat exchange unit formed as a pipe meander is arranged upstream of the side walls of the heating element, the pipe meander comprising a connecting conduit running parallel to the rear wall, the pipe meander having two ends extending into the interior of the combustion chamber, and the flue gas conduit outlet being arranged in the region of the connection conduit.

19. The heating device of claim 1, wherein the heat exchange unit is formed as a U-shaped pipe meander arranged upstream of the side walls and the rear wall of the heating element, the pipe meander having two ends extending into the interior of the combustion chamber, and the flue gas conduit outlet being arranged in a portion of the pipe meander facing the rear wall.

20. The heating device of claim 1, wherein the heat exchange unit is formed as a pipe meander having vertically extending rectilinear pipe portions.

21. The heating device of claim 1, wherein the heat exchange unit is formed as a pipe meander having horizontally extending rectilinear pipe portions.

* * * * *